US007998648B2

(12) United States Patent
Lee et al.

(10) Patent No.: US 7,998,648 B2
(45) Date of Patent: Aug. 16, 2011

(54) ELECTROPHOTOGRAPHIC DEVELOPING AGENT

(75) Inventors: Duck-hee Lee, Seoul (KR); Sang-deok Kim, Gwangmyeong-si (KR); Seok-hoon Choi, Suwon-si (KR); Ki-won Seok, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 656 days.

(21) Appl. No.: 12/007,315

(22) Filed: Jan. 9, 2008
(Under 37 CFR 1.47)

(65) Prior Publication Data

US 2008/0261140 A1 Oct. 23, 2008

(30) Foreign Application Priority Data

Jan. 9, 2007 (KR) ..... 10-2007-0002681

(51) Int. Cl.
*G03G 9/087* (2006.01)

(52) U.S. Cl. ..... 430/108.4; 430/108.8; 430/109.4

(58) Field of Classification Search ..... 430/108.8, 430/109.4, 108.4, 111.4
See application file for complete search history.

(56) References Cited

U.S. PATENT DOCUMENTS

| | | | | |
|---|---|---|---|---|
| 4,626,490 | A * | 12/1986 | Yamazaki et al. | 430/108.4 |
| 5,635,325 | A * | 6/1997 | Inaba et al. | 430/108.4 |
| 5,814,428 | A * | 9/1998 | Kido et al. | 430/108.4 |
| 2003/0108808 | A1* | 6/2003 | Inoue et al. | 430/108.8 |
| 2005/0277046 | A1* | 12/2005 | Sawada et al. | 430/109.4 |
| 2006/0172211 | A1* | 8/2006 | Ueda et al. | 430/108.4 |
| 2006/0210909 | A1* | 9/2006 | Ohtani | 430/137.1 |

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

* cited by examiner

*Primary Examiner* — Christopher RoDee
(74) *Attorney, Agent, or Firm* — Roylance, Abrams, Berdo & Goodman, L.L.P.

(57) ABSTRACT

An electrophotographic developing agent is provided that includes a binder resin, a releasing agent, a colorant, and a charge control agent. By using a binder resin having a high acid value and a mixture of two waxes having different melting points as a releasing agent, a electrophotographic developing agent is obtained, which has excellent fusing property and durability and does not result in hot offset and wrap jamming.

7 Claims, 1 Drawing Sheet

ELECTROPHOTOGRAPHIC DEVELOPING AGENT

CROSS-REFERENCE TO RELATED PATENT APPLICATION

This application claims the benefit under 35 U.S.C. §119 (a) of Korean Patent Application No. 10-2007-0002681, filed on Jan. 9, 2007, in the Korean Intellectual Property Office, the disclosure of which is hereby incorporated by reference in its entirety.

BACKGROUND OF THE INVENTION

1. Field of the Invention

The present invention relates to an electrophotographic developing agent. More particularly, the invention relates to an electrophotographic developing agent having excellent fusing property without filming, streaking, hot offset and wrap jamming on a developing member. The electrophotographic developing agent includes a binder resin having a high acid value and a mixture of a low melting point wax and a high melting point wax as a releasing agent.

2. Description of the Related Art

Electrophotographic image forming apparatuses currently being used include laser printers, facsimile machines, copiers, and the like. These apparatuses form an electrostatic latent image on a photoreceptor using a laser. A toner is transferred to the electrostatic latent image using a potential difference, and a resulting toner image is transferred to a printing medium such as a sheet of paper to form a desired image.

As image forming apparatuses such as electrophotographic laser beam printers (LBPs), multifunction machines, and color copiers are widely used, a high quality image is required. Unlike a mono-printer, a color laser printer expresses various colors using a toner having four basic colors (Cyan, Magenta, Yellow, Black). For example, red is represented with magenta plus yellow. Thus, toner fusing property is more important than in the mono-printer.

Further, in view of environmental issue, less paper should be used and more double-side printing is required for user's convenience. The double-side printing results in more back-side contamination due to hot offset and wrap jam of a fuser than single-side printing. Of these disadvantages, wrap jam is more serious.

Furthermore, even within the life of a toner, image problems such as streaking of the toner itself and filming may be caused by letter or image printing.

To solve these problems, two or more binder resins are mixed and kneaded. The kneading conditions such as kneading temperature, screw rpm and feed rpm is controlled to improve dispersion of a releasing agent. The equipment for melting and kneading itself is improved, or a new type of melting and kneading equipment (e.g., open roll) is used to overcome these problems.

When a low melting point wax is used as a releasing agent to improve the fusing property, hot offset and wrap jam also occur. To reduce these problems, a high melting point wax is added to the low melting wax. However, in this case, the fusing property is deteriorated and it is difficult to disperse the releasing agent in a binder resin. Thus, further improvement in the electrophotographic developing agent is required.

SUMMARY OF THE INVENTION

The present invention provides an electrophotographic developing agent having excellent fusing properties and durability, does not result in streaking and filming on a developing member, and can prevent hot offset and wrap jamming.

The present invention also provides an electrophotographic image forming apparatus using the electrophotographic developing agent.

According to an aspect of the present invention, an electrophotographic developing agent is provided including a binder resin, a releasing agent, a colorant, and a charge control agent, wherein the binder resin is a polyester resin having an acid value of 20 mg-KOH/g or greater and where the releasing agent is a mixture of a low melting point wax and a high melting point wax, the low melting point wax having a melting point lower than a softening point of the binder resin ($T_{1/2}$) and an acid value less than 1 and the high melting point wax having a melting point higher than the melting point of the low melting point wax and lower than the softening point of the binder resin ($T_{1/2}$).

The low melting point wax may have a melting point of about 60 to 110° C.

The high melting point wax may have a melting point of about 80 to 150° C. where the high melting point wax has a melting point higher than the low melting point wax.

A weight ratio of the low melting point wax to the high melting point wax may be about 1:1 to 10:1.

According to another aspect of the present invention, an electrophotographic image forming apparatus is provided using the electrophotographic developing agent.

The electrophotographic developing agent has a wide non-offset area, does not result in streaking and filming on a developing member, can prevent hot offset and wrap jamming, and has improved durability and an improved fusing property.

These and other aspects of the invention will become apparent from the following detailed description of the invention which disclose various embodiments of the invention.

BRIEF DESCRIPTION OF THE DRAWING

The above and other features and advantages of the present invention will become more apparent by describing in detail exemplary embodiments thereof with reference to the attached drawing in which.

DETAILED DESCRIPTION OF THE INVENTION

Figure 1:
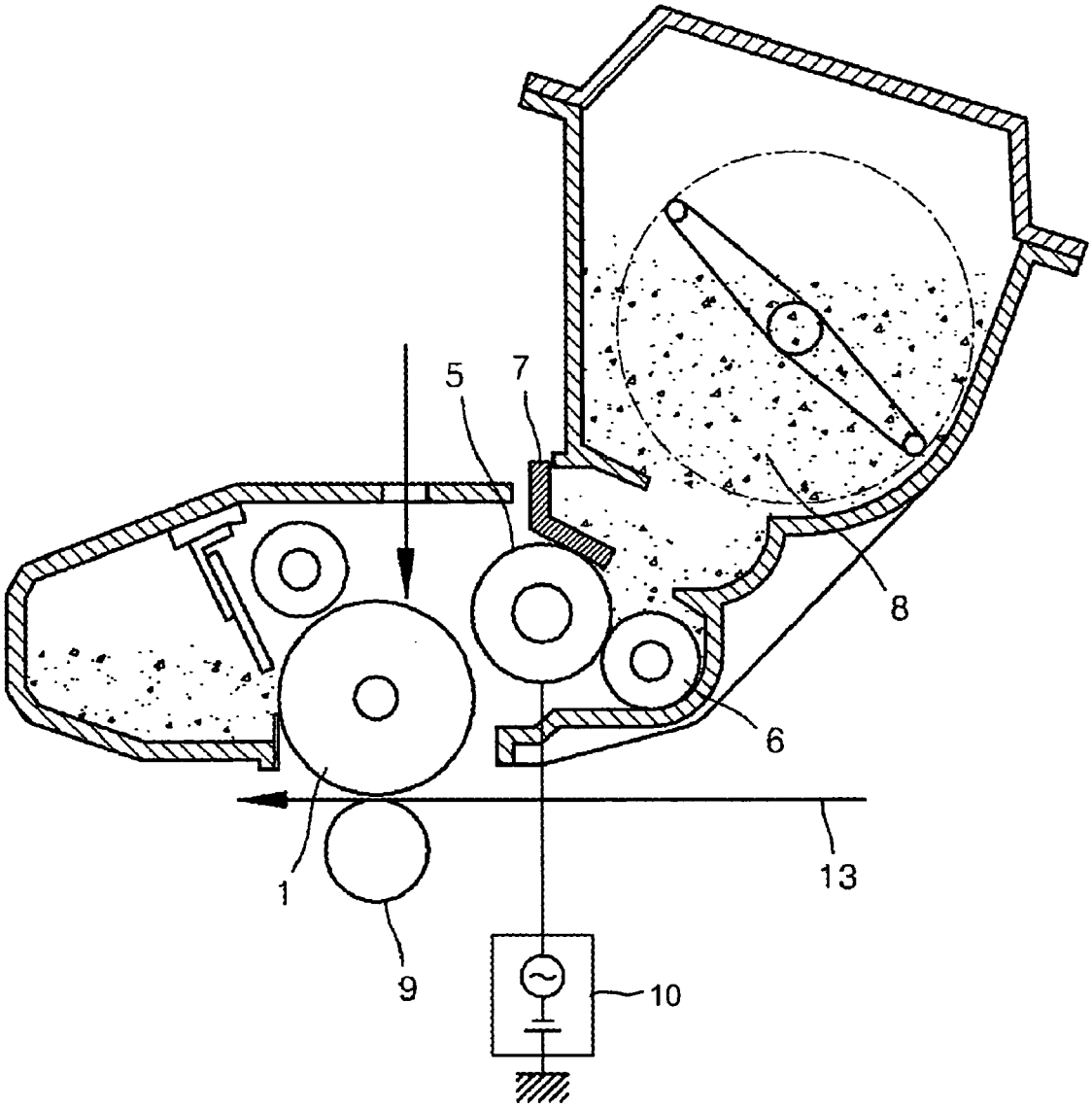
FIG. 1 is a schematic diagram of an embodiment of a non-contact type image forming apparatus.

In an embodiment of the present invention, a binder resin having a high acid value and a mixture of waxes having different melting points as a releasing agent are used in an electrophotographic developing agent to broaden a non-offset area and to prevent streaking, filming on a developing member, hot offset, and wrap jamming. In one embodiment, the electrophotographic developing agent includes a binder resin, a releasing agent, a colorant, and a charge control agent, where the binder resin is a polyester resin having an acid value of 20 mg-KOH/g or greater and the releasing agent is a mixture of a low melting point wax and a high melting point wax. The low melting point wax has a melting point lower than a softening point of the binder resin ($T_{1/2}$) and an acid value less than 1 and the high melting point wax has a melting point higher than the melting point of the low melting point wax and lower than the softening point of the binder resin ($T_{1/2}$).

The polyester resin used in one embodiment of the present invention is synthesized from a polyol and a dicarboxylic acid, where the polyol is an etherified diphenol. Examples of the etherified diphenol include adducts of diphenol, such as bisphenol A or di-(4-hydroxyphenyl)methane, and a compound selected from the group consisting of ethylene oxide, propylene oxide, diethylene glycol, triethylene glycol, polyethylene glycol, dipropylene glycol, polypropylene glycol, polytetramethylene ether glycol, glycerol, trimethylol propane, pentaerythritol, dipentaerythritol, and tripentaerythritol. Examples of dicarboxylic acid include maleic acid, fumaric acid, mesaconic acid, citraconic acid, itaconic acid, glutaconic acid, phthalic acid, isophthalic acid, terephthalic acid, adipic acid, sebacic acid, malonic acid, 1,2,4-benzentricarboxylic acid, 1,2,5-benzentricarboxylic acid, 1,2,4-cyclohexanetricarboxylic acid, 1,2,5-cyclohexane tricarboxylic acid, 1,2,4-butanetricarboxylic acid, 1,3-dicarboxy-2-methyl-2-methylcarboxypropanetetra (methylcarboxy)methane. When the polyester resin is synthesized, polyols and dicarboxylic acids may be used in combination. A combination of polyester resins may also be used.

The acid value of the polyester resin is adjusted to 20 mg-KOH/g or greater.

The adjustment of the acid value may be achieved by controlling the ratio of polyol and dicarboxylic acid of the polyester resin.

The electrophotographic developing agent according to the current embodiment of the present invention includes a mixture of a low melting point wax and a high melting point wax as a releasing agent, in which the low melting point wax has a melting point lower than a softening point of the binder resin ($T_{1/2}$) and an acid value less than 1 and the high melting point wax has a melting point higher than the melting point of the low melting point wax and lower than the softening point of the binder resin ($T_{1/2}$).

The low melting point wax improves the fusing property of the developing agent and the high melting point wax prevents hot offset and wrap jamming.

Preferably, the low melting point wax and the high melting point wax have a melting point lower than the softening point of the binder resin. Typically, in the preparation of a pulverized toner, a melting and kneading process is performed at a temperature around the softening point of the binder resin. Thus, the melting point of waxes should be lower than the softening point of the binder resin such that the waxes can be sufficiently dissolved and dispersed in the binder resin.

The low melting point wax may have a melting point of about 60 to 100° C. and the high melting point wax may have a melting point of about 80 to 150° C. where the melting point of the high melting point wax is higher than the melting point of the low melting point wax.

The low melting point wax may be an ester or a paraffin wax.

Since the binder resin has a high acid value, the low melting point wax should have an acid value less than 1 to maintain the durability of a developing agent and to prevent filming.

The high melting point wax is selected from the group consisting of a paraffin, polyethylene, polypropylene wax, and mixtures thereof.

The acid value of the high melting point wax is not particularly restricted, but may be about 3 mg-KOH/g or greater to disperse it in the binder resin.

The weight ratio of the low melting point wax to the high melting point wax may be about 1:1 to 10:1. When the weight ratio of the low melting point wax to the high melting point wax is less than 1:1, the desired fusing property and durability are not obtained. When the weight ratio of the low melting point wax to the high melting point wax is greater than 10:1, hot offset and wrap jamming may increase.

The electrophotographic developing agent according to the current embodiment of the present invention may include about 1 to 7 parts by weight of the releasing agent based on 100 parts by weight of the binder resin. When the amount of the releasing agent is less than 1 part by weight, fusing property may be deteriorated and offset cannot be prevented. When the amount of the releasing agent is greater than 7 parts by weight, the durability of a toner may be deteriorated.

The electrophotographic developing agent according to the current embodiment of the present invention includes a colorant. A colorant may be carbon black or aniline black for a black toner. In a color toner, carbon black is used as a black colorant. To make colors, yellow colorant, magenta colorant, and cyan colorant are further included.

The yellow colorant may comprise condensed nitrogen compounds, isoindolinone compounds, anthraquinone compounds, azo metal complexes, or allyl imide compounds. Specific examples of such yellow colorants include C.I. Pigment Yellow (PY) 12, 13, 14, 17, 62, 74, 83, 93, 94, 95, 109, 110, 111, 128, 129, 147, 168, 180, and the like.

The magenta colorant may comprise condensed nitrogen compounds, anthraquinone compounds, quinacridone compounds, lake compounds of basic dyestuffs, naphthol compounds, benzimidazole compounds, thioindigo compounds, or phenylene compounds. Specific examples of such magenta colorants include C.I. Pigment Red (PR) 2, 3, 5, 6, 7, 23, 48:2, 48:3, 48:4, 57:1, 81:1, 144, 146, 166, 169, 177, 184, 185, 202, 206, 220, 221 or 254.

The cyan colorant may comprise copper phthalocyanine compounds and derivatives thereof, anthraquinone compounds, or like compounds of basic dyestuffs. Specific examples of such cyan colorants include C.I. Pigment Blue (PB) 1, 7, 15, 15:1, 15:2, 15:3, 15:4, 60, 62 or 66.

These colorants may be used alone or in combination. A desired colorant is selected considering the desired color, saturation, brightness, weather resistance, and dispersity in a toner.

The amount of the colorant may be a sufficient amount to color a toner which can produce a visible phase by development, for example about 2 to 20 parts by weight based on 100 parts by weight of the binder resin. When the amount of the colorant is less than 2 parts by weight, a toner is not sufficiently colored. When the amount of the colorant is greater than 20 parts by weight, sufficient friction charge quantity cannot be obtained due to a low electric resistance of a toner, resulting in contamination of an image.

The colorant may be subject to flushing in advance so that it is uniformly dispersed in a binder resin, or a high concentration of a master batch which is melted and kneaded with the binder resin may be used.

The electrographic developing agent according to the current embodiment of the present invention include a charge control agent. The charge control agent may be a negative chargeable charge control agent, a positive chargeable charge control agent, or both. The charge control agent allows a toner to be supported on a developing roller by means of electrostatic force, which makes stable and rapid charging possible.

Examples of useful negative chargeable charge control agents include organic metal complexes or chelate compounds such as chromium containing azo dyes or monoazo metal complexes; salicylic acid compounds containing metals such as chromium, iron and zinc; and organic metal complexes of aromatic hydroxycarboxylic acid and aromatic dicarboxylic acid. Any known negative chargeable charge control agent may be used.

Examples of the positive chargeable charge control agent include nigrosine and a product thereof modified with fatty acid metal salt etc., onium salts including quaternary ammonium salts such as tributylbenzylammonium 1-hydroxy-4-naphthosulfonate and tetrabutylammonium tetrafluoroborate. These materials may be used alone or in combination.

The electrophotographic developing agent according to the current embodiment of the present invention may contain about 0.1 to 10 parts by weight of the charge control agent based on 100 parts by weight of the binder resin.

The electrophotographic developing agent according to the current embodiment of the present invention can be applied to a contact-type non-magnetic monocomponent toner as well as electrophotographic apparatus using a non-contact type non-magnetic monocomponent toner. Also, it can also be applied to both negative and positive chargeable toners.

In general, polymerized and pulverized toners, the colorant, the charge control agent, the releasing agent, and other components are internally added to the binder to improve the chromaticity, charge characteristic and fusing property and various external additives are added to provide the fluidity, charge stability and cleaning property of the toner. In the addition of external additives, two or more external additives having different average particle diameters may be used in combination to prevent separation of external additives from the toner surface and embedding, resulting in deterioration of the resulting image.

Examples of useful external additives include silica particles, titanium oxide and polymer beads. When silica particles are used, a first silica particle and a second silica particle which have particle diameters different from each other may be added. Average particle diameters of the first and second silica particles may be about 7 to 16 nm and about 30 to 200 nm, respectively. The large particle diameter silica acts as spacer particles to prevent deterioration of a toner and improves transfer characteristic and the small particle diameter silica provides a toner with fluidity.

The amounts of the first and second silica particles are each independently about 0.1 to 3 parts by weight based on 100 parts by weight of toner parent particles. When the amounts of the first and second silica particles are less than 0.1 part by weight, the effects of the silica addition cannot be obtained. When the amounts of the first and second silica particles are greater than 3 parts by weight, it results in a reduction in the fusing property, overcharge and poor cleaning.

Only silica having a relatively high specific surface area is used as an external additive to produce excellent transfer efficiency, but it contaminates a drum upon output for an extended period. Thus, inorganic particles other than silica may be used to produce remarkable improvement. Materials which can be used as inorganic particles may be selected from the group consisting of titanium oxide, aluminum oxide, zinc oxide, magnesium oxide, cerium oxide, iron oxide and tin oxide. Preferably, titanium oxide may be used.

Titanium oxide can improve fluidity of a toner and maintain high transfer efficiency even upon output for an extended period. In addition, titanium oxide can prevent contamination of a drum to improve environmental stability. In particular, the titanium oxide can prevent charge up at a low temperature and a low humidity and charge down at a high temperature and a high humidity.

The amount of titanium oxide may be varied by controlling the two types of silica particles and is preferably about 0.1 to 2 parts by weight, more preferably about 0.1 to 1 part by weight, based on 100 parts by weight of toner parent particles. An amount of titanium oxide less than 0.1 part by weight results in contamination of a drum, and thereby contamination of an image. An amount of titanium oxide greater than 2 parts by weight prevents a desired image from being obtained due to a reduction in a friction charge value.

Polymer beads may also be used as an external additive. They are used to prevent contamination of an image due to contamination of a developing member. The polymer beads may be melanine-based resin or polymethylmethacrylate (PMMA).

The amount of the polymer beads may be about 0.1 to 2.0 parts by weight based on 100 parts by weight of the toner parent particles. When the amount of the polymer beads is less than 0.1 part by weight, contamination of an image cannot be prevented. When the amount of the polymer beads is greater than 2.0 parts by weight, separation and self-aggregation occur.

In another embodiment of the present invention, an electrophotographic image forming apparatus is provided using the electrophotographic developing agent.

The operation principle of an embodiment of a non-contact type image forming apparatus illustrated in FIG. 1 will be described below.

A non-magnetic monocomponent developing agent (8) is fed on a developing roller (5) by a feed roller 6 composed of an elastic member such as a polyurethane foam or sponge. The developing agent (8) arrives at a contact part of a developing agent control blade (7) and the developing roller (5) by rotation of the developing roller (5). The developing agent control blade (7) is composed of an elastic member such as metal or rubber. When the developing agent (8) passes through the contact part of the developing agent control blade (7) and the developing roller (5), the developing agent (8) is controlled to a uniform layer to form a thin layer and is sufficiently charged by a charging device 10. The thin-layered developing agent (8) is transferred to a developing area in which the developing agent (8) is developed into an electrostatic latent image by the developing roller (5) on a photoreceptor (1) which is a latent image support.

The developing roller (5) is spaced a predetermined distance apart from the photoreceptor (1). The developing roller (5) rotates counterclockwise and the photoreceptor (1) rotates clockwise. The developing agent (8) transferred to the developing area is developed into an electrostatic latent image on the photoreceptor (1) by electric power produced a potential difference between DC overlapped AC voltage applied to the developing roller (5) and a latent image potential of the photoreceptor (1).

The developing agent (8) developed on the photoreceptor (1) arrives a transfer means (9) by rotation of the photoreceptor (1). The developing agent (8) is transferred to a printing paper (13) passing between the photoreceptor (1) and the transfer means (9) by the transfer means (9) to which a polar high voltage opposite to the developing agent (8) is applied by corona discharge or in a roller form, thereby forming an image.

The image transferred to the printing paper is fused on the printing paper by fusion of the developing agent to the printing paper while passing through a high pressure fuser (not shown). Meanwhile, undeveloped residual developing agent on the developing roller (5) is recovered by a feed roller (6) contacting with the developing roller (5). Such a procedure is repeated.

The present invention will now be described in greater detail with reference to the following examples. The following examples are for illustrative purposes only and are not intended to limit the scope of the invention.

EXAMPLES

In a non-magnetic monocomponent developing agent, the composition of a toner parent particle is as follows.

| | |
|---|---|
| Polyester (acid value: 25, softening point: 125° C., produced by Sanyo) | 90% by weight |
| Colorant (carbon black) | 5% by weight |
| Low melting point wax (ester wax, melting point: 75° C., acid value: 0) | 2% by weight |
| High melting point wax (polyethylene wax, melting point: 99° C., acid value: 0) | 1% by weight, |
| with the balance being a charge control agent and other components to make 100%. | |

The composition was uniformly pre-mixed using a Henschel type mixer and put into a twin-screw extruder. The melted mixture was extruded at 130° C., cooled and solidified. Then, a toner parent particle having an average particle diameter of about 8 μm was obtained using a mill/classifier without treating with an external additive.

The following external additives were added to the untreated toner particle to prepare the toner according to an embodiment of the present invention. The amount of the external additive is based on 100 parts by weight of the toner parent particles.

| | |
|---|---|
| Negative chargeable silica (primary particle diameter 30-50 nm) | 1.5 parts by weight |
| Negative chargeable silica (primary particle diameter 7-16 nm) | 1.0 part by weight |
| Titanium oxide (primary particle diameter 10-50 nm) | 0.5 part by weight |

Example 2 and Comparative Examples 1-5

Toner particles were prepared in the same manner as Example 1 except that components of toner parent particles and the amounts thereof were used as indicated in Table 1. Ester 2 and Ester 3 refer to low melting point ester waxes. PP refers to a high melting point polypropylene wax.

TABLE 1

| | Binder resin | | Low melting point wax | | | High melting point wax | |
|---|---|---|---|---|---|---|---|
| | Softening point | Acid value | Wax (Tm) | Acid value | Amount (wt %) | Wax (Tm) | Amount (wt %) |
| Example 1 | 125° C. | 25 | Ester 1 (75° C.) | 0 | 2 | PE (99° C.) | 1 |
| Example 2 | 131° C. | 25 | Ester 2 (82° C.) | 0 | 2 | Paraffin (103° C.) | 1 |
| Comparative Example 1 | 130° C. | 25 | Ester 3 (84° C.) | 5 | 2 | PE (99° C.) | 1 |
| Comparative Example 2 | 130° C. | 25 | Ester 1 (75° C.) | 0 | 2 | PP (140° C.) | 1 |
| Comparative Example 3 | 122° C. | 25 | Ester 3 (84° C.) | 5 | 2 | PP (140° C.) | 1 |
| Comparative Example 4 | 122° C. | 25 | — | — | — | PE (99° C.) | 2 |
| Comparative Example 5 | 131° C. | 17 | Ester 3 (84° C.) | 5 | 2 | — | — |

Method of Evaluating Image

Evaluation of the image was performed on the toner particles prepared in Examples 1 and 2 and Comparative Examples 1-5 using a 20 pm grade LBP printer.

—Evaluation Printer—

Output: Single pass manner

Processing rate: 125 mm/sec

Temperature of fuser: 180° C.

<Evaluation of Fusing Property>

Fusing property was determined in a taping manner on a solid image for each color of the evaluation printer under a condition of low temperature and low humidity (10±1° C./10±2RH %) and represented by percentage. Specifically, an adhesive tape (Scotch 810, 3M) was attached to an output image and a 500 g weight was released three times. Then, the adhesive tape was detached at an angle of 180 degrees and the image density after detaching the adhesive tape to the image density before attaching the adhesive tape was represented by percentage. GretagMacbeth D19C (densitometer) was used to determine the image density.

<Occurrence of Streak>

Occurrence of vertical streak on an image was investigated in the printing test.

Evaluation condition: L/L, N/N, H/H conditions

Image: 5% coverage image for each color

Lifetime: printed 5000 sheets

<Occurrence of Wrap Jamming>

60 g and 75 g printing papers were used to evaluate wrap jamming at a high temperature and at a high humidity.

The image evaluation results are shown in Table 2.

TABLE 2

| | Fusing property (%) | Occurrence of streaking | Occurrence of Wrap jamming |
|---|---|---|---|
| Example 1 | 81 | ○ | ○ |
| Example 2 | 77 | ○ | ○ |
| Comparative Example 1 | 80 | X | ○ |
| Comparative Example 2 | 68 | X | ○ |
| Comparative Example 3 | 76 | X | ○ |
| Comparative Example 4 | 34 | Δ | ○ |
| Comparative Example 5 | 45 | ○ | Δ |

In Table 2, occurrence of streaking and wrap jamming is visually determined. No occurrence of these problems is represented by "○", slight occurrence by "Δ" and significant occurrence by "x".

Criterion for Determination of Streaking

Slight occurrence: Streaking was observed on a developing roller, but not on an image.

Significant occurrence: Streaking was visually confirmed on an image.

Criterion for Determination of Wrap Jamming

Slight occurrence: One or less per 1000 sheets occurred (based on a general 75 g sheet).

Significant occurrence: Two or more per 1000 sheets occurred (based on a general 75 g sheet)

As can be seen from the above Table, the toner according to an embodiment of the present invention has a high fusing property of 70% or greater and does not result in streaking and wrap jamming.

According to present invention, an electrophotographic developing agent having good fusing property and durability and preventing hot offset and wrap jamming can be prepared by using a binder resin having a high acid value and a mixture of waxes having different melting points as a releasing agent.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An electrophotographic developing agent comprising a binder resin, a releasing agent, a colorant, and a charge control agent, wherein the binder resin is a polyester resin having an acid value of 20 mg-KOH/g or greater and the releasing agent is a mixture of a low melting point wax and a high melting point wax, the low melting point wax having a melting point lower than a softening point of the binder resin ($T_{1/2}$), a melting point of about 60 to 110° C. and an acid value less than 1 mg-KOH/g, the low melting point wax being an ester wax, and the high melting point wax having a melting point higher than the melting point of the low melting point wax and lower than the softening point of the binder resin ($T_{1/2}$), a melting point of about 80 to 150° C. and acid value of 3 mg-KOH/g or greater.

2. The electrophotographic developing agent of claim 1, wherein a weight ratio of the low melting point wax to the high melting point wax is about 1:1 to about 10:1.

3. The electrophotographic developing agent of claim 1, wherein an amount of the releasing agent is about 1 to 7 parts by weight based on 100 parts by weight of the binder resin.

4. The electrophotographic developing agent of claim 1, wherein an amount of the colorant is about 2 to 20 parts by weight based on 100 parts by weight of the binder resin.

5. The electrophotographic developing agent of claim 1, wherein an amount of the charge control agent is about 0.1 to 10 parts by weight based on 100 parts by weight of the binder resin.

6. The electrophotographic developing agent of claim 1, wherein the high melting point wax is selected from the group consisting of a paraffin, polyethylene, polypropylene wax, and mixtures thereof.

7. The electrophotographic developing agent of claim 1, wherein the polyester resin is obtained from an etherified diphenol and a dicarboxylic acid.

* * * * *